US011399253B2

(12) United States Patent
Aharoni et al.

(10) Patent No.: US 11,399,253 B2
(45) Date of Patent: Jul. 26, 2022

(54) SYSTEM AND METHODS FOR VOCAL INTERACTION PRESERVATION UPON TELEPORTATION

(71) Applicant: InSoundz Ltd., Tel Aviv (IL)

(72) Inventors: Yadin Aharoni, Tel Aviv (IL); Tomer Goshen, Hod Hasharon (IL); Itai Matos, Kochav Yair (IL); Doron Koren, Even Yehuda (IL); Emil Winebrand, Petah Tikva (IL); Guy Etgar, Tel Aviv (IL)

(73) Assignee: Insoundz Ltd., Tel Aviv (IL)

( * ) Notice: Subject to any disclaimer, the term of this patent is extended or adjusted under 35 U.S.C. 154(b) by 114 days.

(21) Appl. No.: 16/892,677

(22) Filed: Jun. 4, 2020

(65) Prior Publication Data

US 2020/0389752 A1 Dec. 10, 2020

Related U.S. Application Data

(60) Provisional application No. 62/858,053, filed on Jun. 6, 2019.

(51) Int. Cl.

| | |
|---|---|
| ***H04S 7/00*** | (2006.01) |
| ***H04R 5/04*** | (2006.01) |
| ***H04R 3/00*** | (2006.01) |

(52) U.S. Cl.

CPC ..... *H04S 7/303* (2013.01); *H04R 3/005* (2013.01); *H04R 5/04* (2013.01)

(58) Field of Classification Search

None

See application file for complete search history.

(56) References Cited

U.S. PATENT DOCUMENTS

| | | | |
|---|---|---|---|
| 7,116,789 | B2 | 10/2006 | Layton et al. |
| 7,756,274 | B2 | 7/2010 | Layton et al. |
| 9,485,556 | B1 | 11/2016 | List |
| 9,716,945 | B2 | 7/2017 | Lesso et al. |
| 9,788,108 | B2 | 10/2017 | Goshen et al. |
| 9,900,694 | B1 | 2/2018 | List |
| 10,031,718 | B2 | 7/2018 | Dack et al. |
| 10,089,785 | B2 | 10/2018 | Demirli et al. |
| 10,231,073 | B2 | 3/2019 | Stein et al. |
| 10,256,785 | B2 | 4/2019 | Seefeldt |
| 10,278,000 | B2 | 4/2019 | Breebaart et al. |
| 10,299,056 | B2 | 5/2019 | Walsh et al. |

(Continued)

*Primary Examiner* — Paul W Huber

(74) *Attorney, Agent, or Firm* — M&B IP Analysts, LLC

(57) ABSTRACT

Methods and systems for vocal interaction preservation for teleported audio. A method includes determining spatial parameters of a first space including at least one sound source and at least one audio source, wherein the at least one sound source emits sound within the first space, wherein the at least one audio source captures audio data based on sounds emitted within the first space, wherein the spatial parameters of the first space characterize sound characteristics of the first space; determining vocal spatial parameters of each of the at least one sound source, wherein the vocal spatial parameters of each sound source define characteristics of the sound source which affect sound waves emitted by the sound source; and generating, for each sound source, a respective clean version of the audio data based on the spatial parameters of the first space and the vocal spatial parameters of the sound source.

22 Claims, 8 Drawing Sheets

(56) References Cited

U.S. PATENT DOCUMENTS

| | | | | |
|---|---|---|---|---|
| 2010/0266112 | A1* | 10/2010 | Burstrom | H04M 3/56 379/202.01 |
| 2015/0350787 | A1 | 12/2015 | Goshen et al. | |
| 2015/0382127 | A1* | 12/2015 | Sun | H04S 7/30 381/17 |
| 2018/0160251 | A1 | 6/2018 | Sanger et al. | |
| 2018/0192075 | A1 | 7/2018 | Chambers et al. | |
| 2018/0249276 | A1 | 8/2018 | Godfrey | |
| 2018/0295259 | A1 | 10/2018 | Goshen et al. | |
| 2019/0027164 | A1 | 1/2019 | Goshen et al. | |
| 2019/0068529 | A1 | 2/2019 | Mullins | |
| 2019/0104364 | A1 | 4/2019 | Nawfal et al. | |
| 2019/0105568 | A1 | 4/2019 | Platt et al. | |

* cited by examiner

SYSTEM AND METHODS FOR VOCAL INTERACTION PRESERVATION UPON TELEPORTATION

CROSS-REFERENCE TO RELATED APPLICATIONS

This application claims the benefit of U.S. Provisional Application No. 62/858,053 filed on Jun. 6, 2019, the contents of which are hereby incorporated by reference.

TECHNICAL FIELD

The present disclosure relates generally to the determination of vocal interactions between people, and more particularly to the preservation of the vocal interaction characteristics during teleportation of the vocal interaction.

BACKGROUND

In modern communication between people, the use of audio with or without accompanying video has become common place. A variety of solutions for enabling collaboration of persons over short or long distances have been developed. Solutions such as Skype®, Google Hangouts®, or Zoom™ are just but a few examples of applications and utilities that enable such communications over the internet. These applications and utilities provide both audio and video capabilities.

Although these applications and utilities provide great value in communicating, these solutions do have some significant limitations. Consider, for example, the case in which two people, person A and person B, are speaking to each other in one room while another person, person C, listens in another room. In this kind of setup, the person C determine whether person A and/or person B are actually speaking to person C, are speaking to each other, or are simply thinking aloud. In the absence of a video feed, making this determination becomes even more difficult.

Further, a more complex situation occurs where augmented reality (AR) is utilized. Person A and person B are visualized for person C as avatars that person C (or, for that matter, any other utility or person). These avatars may be placed in positions that do not necessarily reflect the original locations in which person A and person B conduct their conversation relative to each other. For example, the distances may be different, the acoustic characteristics of the space may vary, or the sounds heard by person C may not otherwise reflect reality.

It would therefore be advantageous to provide a solution that would overcome the challenges noted above.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "some embodiments" or "certain embodiments" may be used herein to refer to a single embodiment or multiple embodiments of the disclosure.

Certain embodiments disclosed herein include a method for vocal interaction preservation for teleported audio. The method comprises: determining spatial parameters of a first space, the first space including at least one sound source and at least one audio source, wherein the at least one sound source emits sound within the first space, wherein the at least one audio source captures audio data based on sounds emitted within the first space, wherein the spatial parameters of the first space characterize the first space with respect to sound characteristics of sounds emitted within the first space; determining vocal spatial parameters of each of the at least one sound source, wherein the vocal spatial parameters of each sound source define characteristics of the sound source which affect sound waves emitted by the sound source; and generating, for each of the at least one sound source, a respective clean version of the audio data based on the spatial parameters of the first space and the vocal spatial parameters of the sound source.

Certain embodiments disclosed herein also include a non-transitory computer readable medium having stored thereon causing a processing circuitry to execute a process, the process comprising: determining spatial parameters of a first space, the first space including at least one sound source and at least one audio source, wherein the at least one sound source emits sound within the first space, wherein the at least one audio source captures audio data based on sounds emitted within the first space, wherein the spatial parameters of the first space characterize the first space with respect to sound characteristics of sounds emitted within the first space; determining vocal spatial parameters of each of the at least one sound source, wherein the vocal spatial parameters of each sound source define characteristics of the sound source which affect sound waves emitted by the sound source; and generating, for each of the at least one sound source, a respective clean version of the audio data based on the spatial parameters of the first space and the vocal spatial parameters of the sound source.

Certain embodiments disclosed herein also include a system for vocal interaction preservation for teleported audio. The system comprises: a processing circuitry; and a memory, the memory containing instructions that, when executed by the processing circuitry, configure the system to: determine spatial parameters of a first space, the first space including at least one sound source and at least one audio source, wherein the at least one sound source emits sound within the first space, wherein the at least one audio source captures audio data based on sounds emitted within the first space, wherein the spatial parameters of the first space characterize the first space with respect to sound characteristics of sounds emitted within the first space; determine vocal spatial parameters of each of the at least one sound source, wherein the vocal spatial parameters of each sound source define characteristics of the sound source which affect sound waves emitted by the sound source; and generate, for each of the at least one sound source, a respective clean version of the audio data based on the spatial parameters of the first space and the vocal spatial parameters of the sound source.

Certain embodiments disclosed herein also include a method for vocal interaction preservation for teleported audio. The method comprises: determining spatial parameters of a second space, wherein the spatial parameters of the second space characterize the second space with respect to sound characteristics of sounds emitted within the first space; and generating, for each of at least one sound source in a first space, an adjusted version of audio data based on audio data captured in the first space and the spatial parameters of the second space, wherein the audio data is captured based on sound emitted by the at least one sound source in the first space.

Certain embodiments disclosed herein also include a non-transitory computer readable medium having stored thereon causing a processing circuitry to execute a process, the process comprising: determining spatial parameters of a second space, wherein the spatial parameters of the second space characterize the second space with respect to sound characteristics of sounds emitted within the first space; and generating, for each of at least one sound source in a first space, an adjusted version of audio data based on audio data captured in the first space and the spatial parameters of the second space, wherein the audio data is captured based on sound emitted by the at least one sound source in the first space.

Certain embodiments disclosed herein also include a system for vocal interaction preservation for teleported audio. The system comprises: a processing circuitry; and a memory, the memory containing instructions that, when executed by the processing circuitry, configure the system to: determine spatial parameters of a second space, wherein the spatial parameters of the second space characterize the second space with respect to sound characteristics of sounds emitted within the first space; and generate, for each of at least one sound source in a first space, an adjusted version of audio data based on audio data captured in the first space and the spatial parameters of the second space, wherein the audio data is captured based on sound emitted by the at least one sound source in the first space.

BRIEF DESCRIPTION OF THE DRAWINGS

The subject matter that is regarded as the disclosure is particularly pointed out and distinctly claimed in the claims at the conclusion of the specification. The foregoing and other objects, features, and advantages of the invention will be apparent from the following detailed description taken in conjunction with the accompanying drawings.

DETAILED DESCRIPTION

Figure 1:
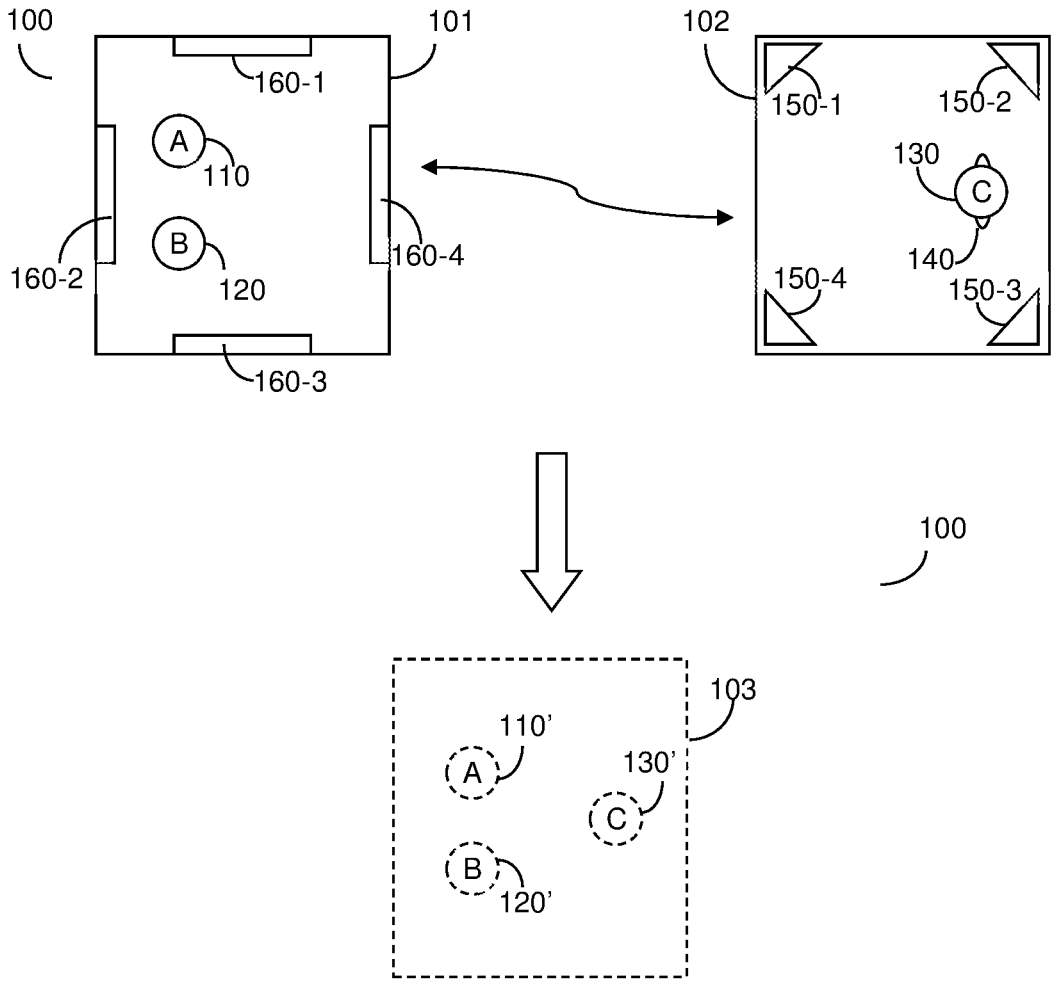
FIG. 1 is a flow diagram illustrating first and second spaces used for the purpose of vocal interaction preservation of spatial audio.

It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

According to various disclosed embodiments, teleporting audio is a process including sending audio data recorded at one location to another location for projection (e.g., via speakers of a device at the second location). The disclosed embodiments provide techniques for modifying audio data that has been or will be teleported such that projection of the teleported audio reflects audio effects at the location of origin. The result is audio at the second location that more accurately approximates the characteristics of the sound as heard by people at the first location.

To this end, according to various disclosed embodiments, teleporting an audio experience from audio sources in a first space to a listener in a second space is performed by determining the spatial audio characteristics of both the first and second spaces. Audio sources (e.g., microphone arrays) are placed in the first space to capture audio generated by sound sources (e.g., speakers projecting sound) in the first space and their spatial parameters are determined. The audio is then cleaned from the sound-altering effects of the first space and adjusted to the spatial characteristics of the second space. The adjusted audio is provided to the listener in the second space, thereby teleporting the audio experience from the first space to the second space.

The various disclosed embodiments may be utilized to adjust audio such that the audio reflects positions and orientations of sound sources with respect to altered reality environments even when those altered reality positions and orientations are different from their positions and orientations at the real-world locations and orientations of those sound sources. To this end, it is noted that such altered realities are realities projected to a user (e.g., via a headset or other visual projection device) in which at least a portion of the environment presented to the user is virtual (i.e., at least a portion of the environment is generated via software and is not physically present at the location in which the altered reality is projected). Such altered realities may include, but are not limited to, augmented realities, virtual realities, virtualized realities, mixed realities, and the like. In an altered reality embodiment, the speakers may be placed at will in the second space and the audio may be adjusted to account for their new positions while preserving the spatial interaction of each speaker.

FIG. 1 is an example flow diagram 100 illustrating first and second spaces used for the purpose of vocal interaction preservation of spatial audio. FIG. 1 depicts a first space 101 and a second space 102 as well as a visual representation of a third merged space 103.

The first space 101 contains audio sources in the form of microphone arrays 160-1 through 160-4 (hereinafter referred to collectively as microphone arrays 160 for simplicity purposes). In an example implementation, such microphone arrays 160 are mounted on the walls of the first space 101. It should be noted that sound sources may be configured differently with respect to placement within a room, for example, by mounting on other surfaces, placed on stands, and the like.

Within the first space 101, a first person A 110 and a second person B 120 may interact with each other as well as speak to a person in another space as explained further herein. As a person (e.g., the person A 110) speaks, that person may speak facing the other person (e.g., person B 120), or may change the position and orientation of their head, other body parts, or their body as a whole, in many ways (e.g., by turning or tilting their head, turning or moving their body, etc.). The sound generated by the person A 110 will therefore have different audio qualities to a listener depending on these changes in position and orientation. The sound generated by the person A 110 is further affected by the distinctive characteristics of the space 101, for example the position and orientation of the person A 110 relative to walls or other surfaces from which sound waves may bounce and, therefore, how sound travels throughout the space 101. That is, sound produced by the person A 110 will travel differently within the space 101 depending on the orientation of the person A 110 relative to the walls of the space 101.

In the second space 102 depicted in FIG. 1, there is a third person C 130 that may be interacting with the person A 110 and the person B 120. As a non-limiting example, the person C 130 may be wearing a binaural headset 140 listening through speakers 150-1 through 150-4 (hereinafter referred to as speakers 150 for simplicity) placed within the second space 102, or both.

It has been identified that, from an audio perspective, it is often desirable to generate for the person C 130 an augmented reality of the person A 110 and the person B 120 as if they are all in the same space, for example as represented in visual representation of a virtual space 103. To this end, as shown in FIG. 1, the virtual space 103 includes virtual representations 110', 120', and 130', representing persons A 110, B 120, and C 130, respectively.

Generating audio such that persons in different spaces sound as if they occupy the same space requires vocal interaction preservation of spatial audio when performed according to embodiments described herein. Without altering the audio captured at the first space 101 and teleported to the second space 102, the resulting sound heard by person C 130 when person A 110 speaks may have significantly different characteristics than would be heard by person C 130 if person C 130 were in the space 101 at the same position and orientation relative to persons A 110 and B 120 (i.e., as represented by the third space 103). As a non-limiting example, it might sound as if person B 120 was projecting in the direction of person C 130 even when the orientation of the head of person B 120 (head not shown) is such that the mouth (not shown) of person B 120 is facing person A 110 but not person C 130.

According to various disclosed embodiments, the audio teleported and projected to any or all of the persons A 110, B 120, or C 130, is modified such that each modified audio reflects the virtual representation shown as the space 103.

Figure 2:
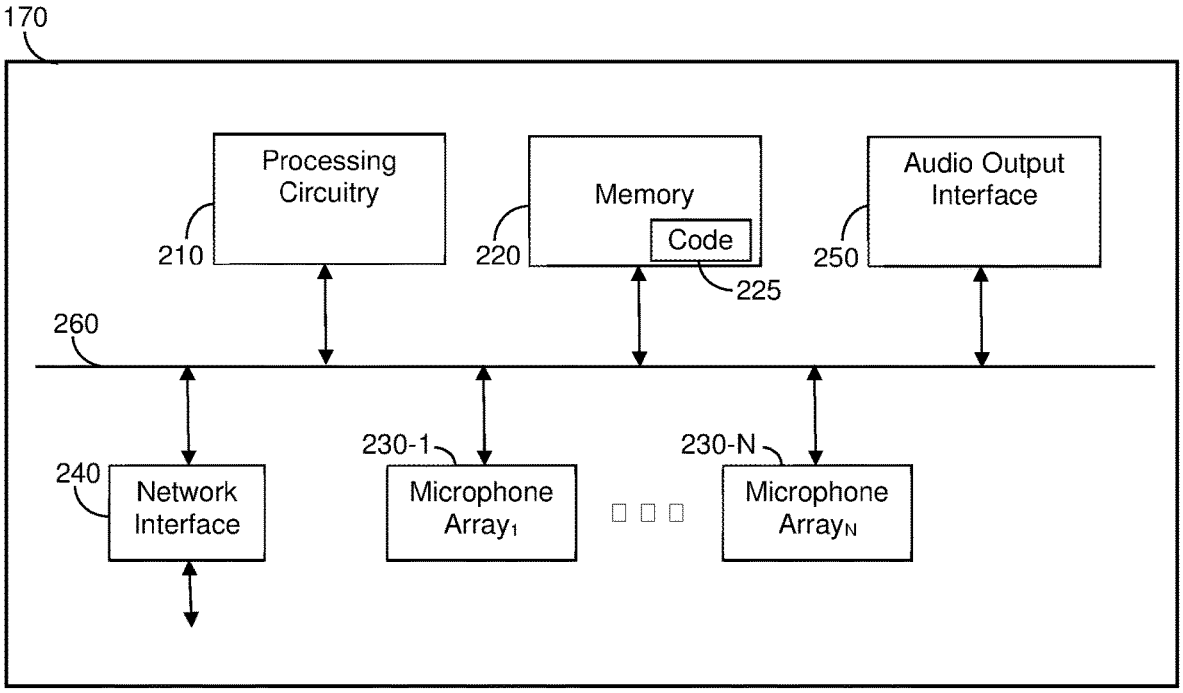
FIG. 2 is a schematic diagram illustrating a spatial audio preserver according to an embodiment.
Figure 3:
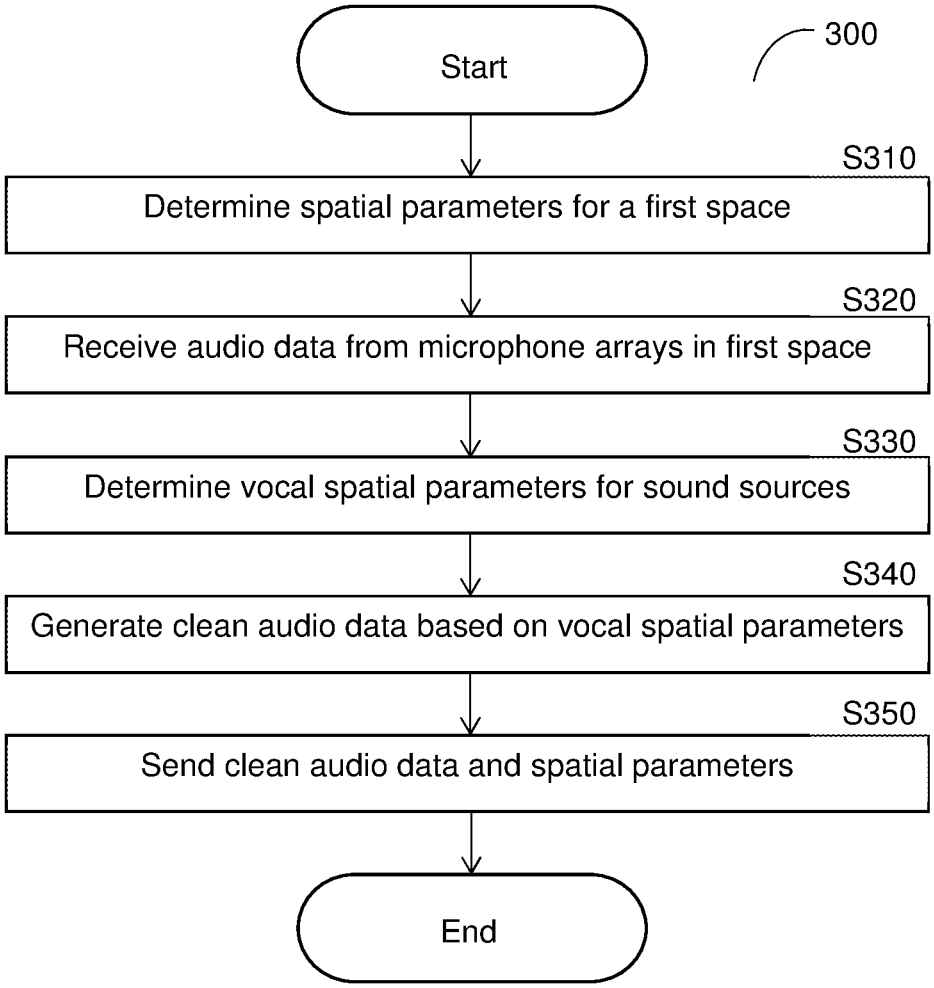
FIG. 3 is a flowchart illustrating a method for vocal interaction preservation of spatial audio transmission according to an embodiment.

In the embodiment shown in FIG. 1, a spatial audio preserver 170, explained in greater detail in FIG. 2, is configured to perform at least a portion of the disclosed embodiments (e.g., at least the method of FIG. 3). To this end, the spatial audio preserver 170 may be configured as described with respect to FIG. 2 including the microphone arrays 160, shown as microphone arrays 230 in FIG. 2, as part of the logical arrangement of components of the spatial audio preserver 170. Other components of the spatial audio preserver 170 are not shown in FIG. 1 and, instead, are described further below with respect to FIG. 2. The second space 102 may further include another spatial audio preserver (not shown), for example, a spatial audio preserver included in the binaural headset 140. That spatial preserver may likewise be configured to perform at least a portion of the disclosed embodiments (e.g., at least the method of FIG. 4, FIG. 6, or FIG. 8).

FIG. 2 is an example schematic diagram illustrating a spatial audio preserver 170 according to an embodiment. The spatial audio preserver 170 includes a processing circuitry 210 coupled to a memory 220, microphone arrays 230-1 through 230-N (hereinafter referred to as a microphone array 230 or microphone arrays 230 for simplicity purposes), a network interface 240, and an audio output interface 250. In an embodiment, the components of the spatial audio preserver 170 may be communicatively connected via a bus 260.

The processing circuitry 210 may be realized as one or more hardware logic components and circuits. For example, and without limitation, illustrative types of hardware logic components that can be used include field programmable gate arrays (FPGAs), application-specific integrated circuits (ASICs), Application-specific standard products (ASSPs), system-on-a-chip systems (SOCs), graphics processing units (GPUs), tensor processing units (TPUs), general-purpose microprocessors, microcontrollers, digital signal processors (DSPs), and the like, or any other hardware logic components that can perform calculations or other manipulations of information.

The memory 220 may be volatile (e.g., random access memory, etc.), non-volatile (e.g., read only memory, flash memory, etc.), or a combination thereof. The memory 220 includes code 225. The code constitutes software for at least implementing one or more of the disclosed embodiments. Software shall be construed broadly to mean any type of instructions, whether referred to as software, firmware, middleware, microcode, hardware description language, or otherwise. Instructions may include code (e.g., in source code format, binary code format, executable code format, or any other suitable format of code). The instructions, when executed by the processing circuitry 210, cause the processing circuitry 210 to perform the respective processes.

The microphone arrays 230 are configured to capture sounds at the location in which the spatial audio preserver 170 is deployed. An example operation of a microphone array is provided in U.S. Pat. No. 9,788,108, titled "System and Methods Thereof for Processing Sound Beams", assigned to the common assignee. It should be noted, however, that the microphone arrays 230 do not need to be utilized for beam forming as described therein. According to the disclosed embodiments, sounds captured by the microphone arrays 230 are utilized to enable modification of sounds so as to recreate the sound experience at a first space in a second space as described herein. This may include neutralizing sound effects introduced by spatial configuration of the first space as captured by the microphone arrays 230.

The network interface 240 is communicatively connected to the processing circuitry 210 and enables the spatial audio preserver 170 to communicate with a system in one or more other spaces (e.g., the second space 102) and to transfer audio signals over networks (not shown). Such networks may include, but are not limited to, local area networks (LANs), wide area networks (WANs), the Internet, the worldwide web (WWW), and other standard or dedicated network interfaces, wired or wireless, and any combinations thereof.

One of ordinary skill in the art would readily appreciate that if the spaces 101 and 102 are to be identically equipped, the spatial audio preserver 170 may further contain an interface to audio output devices such as, but not limited to, the binaural headset 140, the speakers 150, and the like. To this end, the spatial audio preserver 170 includes the audio output interface 250. The processing circuitry 210 may process audio data as described herein and provide the processed audio data for projection via the audio output interface 250. The spatial audio preserver 170 is therefore enabled to: 1) calculate vocal spatial parameters for each sound source; 2) reconstruct a clean sound for each sound source that is free from noise and room reverberations; 3) render the sound according to the captured sound and directionality of the sound according to the spatial parameters for each sound source; and 4) deliver the rendered sound to one or more audio output devices such as a binaural headset (headphones) or a system for three-dimensional sound delivery (e.g., a plurality of loudspeakers).

It should be understood that the embodiments described herein are not limited to the specific architecture illustrated in FIG. 2, and other architectures may be equally used without departing from the scope of the disclosed embodiments. In particular, multiple microphone arrays 230 are depicted, but a single microphone array may be equally utilized. Additionally, in some embodiments, the spatial audio preserver 170 may not include any microphone arrays, for example, as shown in FIG. 1, the spatial audio preserver 170 may be communicatively connected to microphone arrays (e.g., the arrays 160) that are not included therein.

FIG. 3 is an example flowchart 300 illustrating a method for vocal interaction preservation of spatial audio transmission according to an embodiment. In an embodiment, the method is performed by the spatial audio preserver 170.

At S310, the spatial parameters of a first space (e.g., the first space 101) are determined. The spatial parameters of a space characterize the space with respect to sound characteristics of sounds made within the space. The spatial parameters may include, but are not limited to, inherent noise characteristics, acoustic characteristics, reverberation characteristics, or a combination thereof. This operation is performed using sound received by the microphone arrays without the presence of the sources to be teleported to the second space. As a non-limiting example, but not by way of limitation, noise characteristics, acoustic characteristics, reverberation characteristics, or a combination thereof, may be estimated based on a chirp stimulus placed in discrete positions within the first space 101.

At S320, audio data is received from audio sources deployed in a first space (e.g., the microphone arrays 160 in the space 101 of FIG. 1 or the microphone arrays 230 of FIG. 2).

At S330, vocal spatial parameters are determined for each sound source. The vocal spatial parameters of a sound source define characteristics of the sound source that affect sound waves emitted by the sound source and, therefore, how sounds made by that sound source are heard. The vocal spatial parameters may include, but are not limited to, directionality as well as other sound parameters and data. Each vocal spatial parameter is determined based on the energy of the sound detected by an applicable audio source in the first space (e.g., a sound made by the person A 110 or the person B 120 that is detected by one or more of the microphone arrays 160, FIG. 1). Example and non-limiting methods for determination of such vocal spatial parameters may be found in U.S. patent application Ser. No. 16/229,840, titled "System and Method for Volumetric Sound Generation", assigned to the common assignee, the contents of which are hereby incorporated by reference.

At S340, for each sound source in the first space, a clean version of audio data from that sound source is generated. Each clean version of audio data is stripped of the effects of the noise and reverberation determined for the first space, using the spatial parameters determined at S310 and the vocal spatial parameters determined at S330. In an embodiment, the cleaned audio data also includes metadata regarding the audio data, for example the orientation of the sound sources with respect of each other. Such metadata may be used to adjust the audio for projection at the second space in order to reflect the relative orientations and positions of the sound sources at the location of origin of the sounds. This may be performed, as a non-limiting example, by employing sound reconstruction techniques such as beam forming. Example sound reconstruction techniques are discussed further in U.S. Pat. No. 9,788,108 titled "System and Methods Thereof for Processing Sound Beams", assigned to the common assignee, the contents of which are hereby incorporated by reference.

At S350, the cleaned audio for each source may be delivered to a system in a second space (e.g., the second space 102, FIG. 1) for the purpose of teleporting the reconstructed sound over audio output devices in the second space (e.g., the binaural headset 140 or the plurality of speakers 150, FIG. 1. In an embodiment, the spatial parameters of the first space are sent along with the cleaned audio data.

Figure 4:
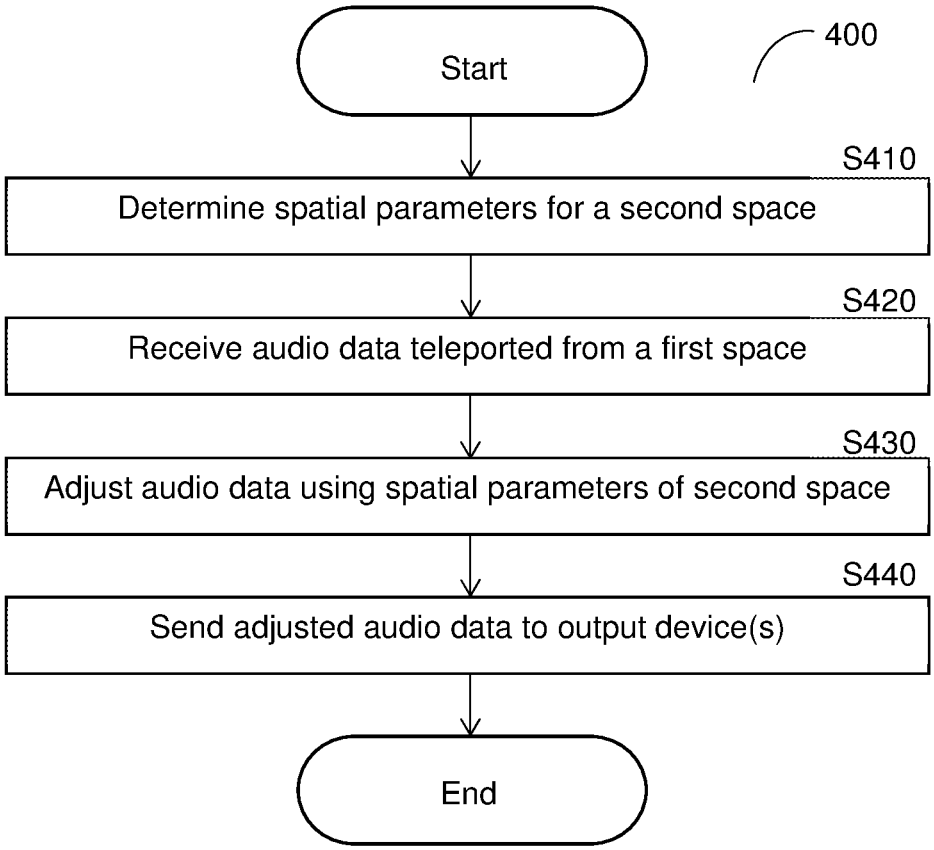
FIG. 4 is a flowchart illustrating a method for vocal interaction preservation of spatial audio reception in another embodiment.

In an embodiment, the cleaned audio may be adjusted based on spatial parameters of the second space, for example as described in FIG. 4. To this end, S350 may further include receiving spatial parameters of the second space and generating adjusted audio based on the cleaned audio data and the spatial parameters of the second space. In another embodiment, the cleaned audio may be sent to a system (e.g., a spatial audio preserver deployed at the second space) for such adjustments.

One of ordinary skill in the art would readily appreciate that the determination of spatial parameters is described as a single step S310, but that such an implementation is not limiting on the disclosed embodiments. Such a step may be performed continuously or repeatedly (e.g., periodically) without departing from the scope of the disclosure.

FIG. 4 is an example flowchart 400 illustrating a method for vocal interaction preservation of spatial audio reception according to another embodiment. In an embodiment, the method is performed by a spatial audio preserver such as the spatial audio preserver 170, FIG. 2.

At S410, the spatial parameters of a second space (e.g., the second space 102, FIG. 1) are determined. The spatial parameters characterize the second space with respect to its inherent noise characteristics, acoustic characteristics, reverberation characteristics, or a combination thereof. This operation is performed using sound received by the microphone arrays without the presence of the sources to be teleported to the second space.

At S420, audio data destined for teleporting in the second space is received, for example, from a system deployed in a first space (e.g., the first space 101, FIG. 1).

At S430, received audio data is adjusted using the spatial parameters determined for the second space at S410.

At S440, the adjusted audio data is provided to audio output device(s) (e.g., the headset 140, the speakers 150, or both).

One of ordinary skill in the art would readily appreciate that the determination of spatial parameters is described as a single step S410, but that such an implementation is not limiting on the disclosed embodiments. Such a step may be performed continuously or repeatedly (e.g., periodically) without departing from the scope of the disclosure.

Figure 5:
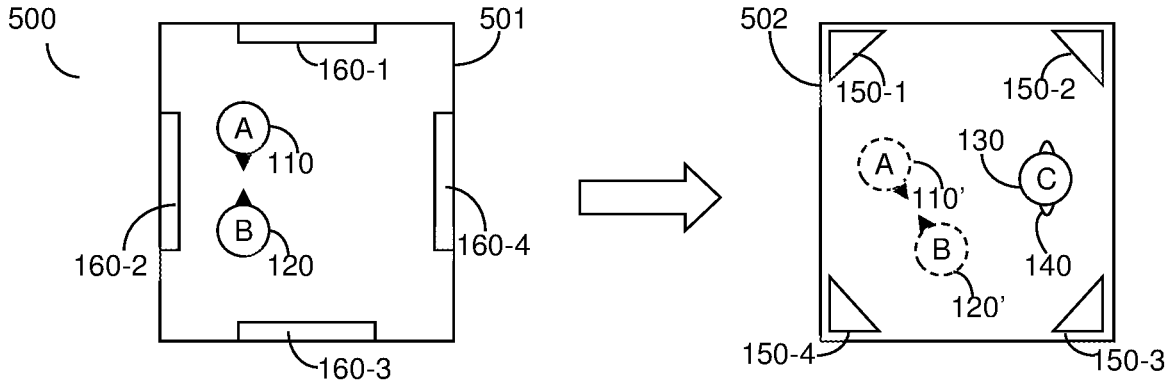
FIG. 5 is a flow diagram illustrating first and second spaces used for the purpose of vocal interaction preservation of spatial audio in altered realities with the same inertial orientation.

FIG. 5 is an example flow diagram 500 illustrating first and second spaces used for the purpose of vocal interaction preservation of spatial audio in altered realities with the same inertial orientation.

In the example flow diagram 500, person A 110 and person B 120 in the first space 501 are in the position shown in FIG. 1 and oriented such that they are facing each other but their respective orientations with respect to person C 130 are different. That is, because in the AR construction, virtual representations such as avatars 110' and 120' of persons 110 and 120, respectively, are oriented differently with respect to person C 130 than with respect to each other.

In the example flow diagram 500, the avatar 120' is closer to the person C 130 and at a different spatial orientation than shown in, for example, FIG. 1. This has an impact on the audio that the person C 130 should hear so as to give that person the proper feel of the audio teleported as it would be if the real persons 110 and 120 were placed in that particular orientation. To this end, in an embodiment, capturing audio data and adjusting it for projection to the person C 130 may be performed as described with respect to FIG. 3.

While the method of capturing the audio data and adjusting it for the transportation from the first space 501 to the second space 502 remains as described in flowchart 300, the reproduction of the audio data by a system located in the second space 502 is different as explained herein. Information of the desired orientation of the avatars 110' and 120' is teleported to a system configured for adjusting audio data, for example the spatial audio preserver 170 shown in FIG. 2. The system may be further equipped with audio output devices such as a binaural headset, a plurality of loudspeakers, or both. The system renders the sound based on the audio data and the directionality of the sound according to the desired spatial orientation for each sound source.

Figure 6:
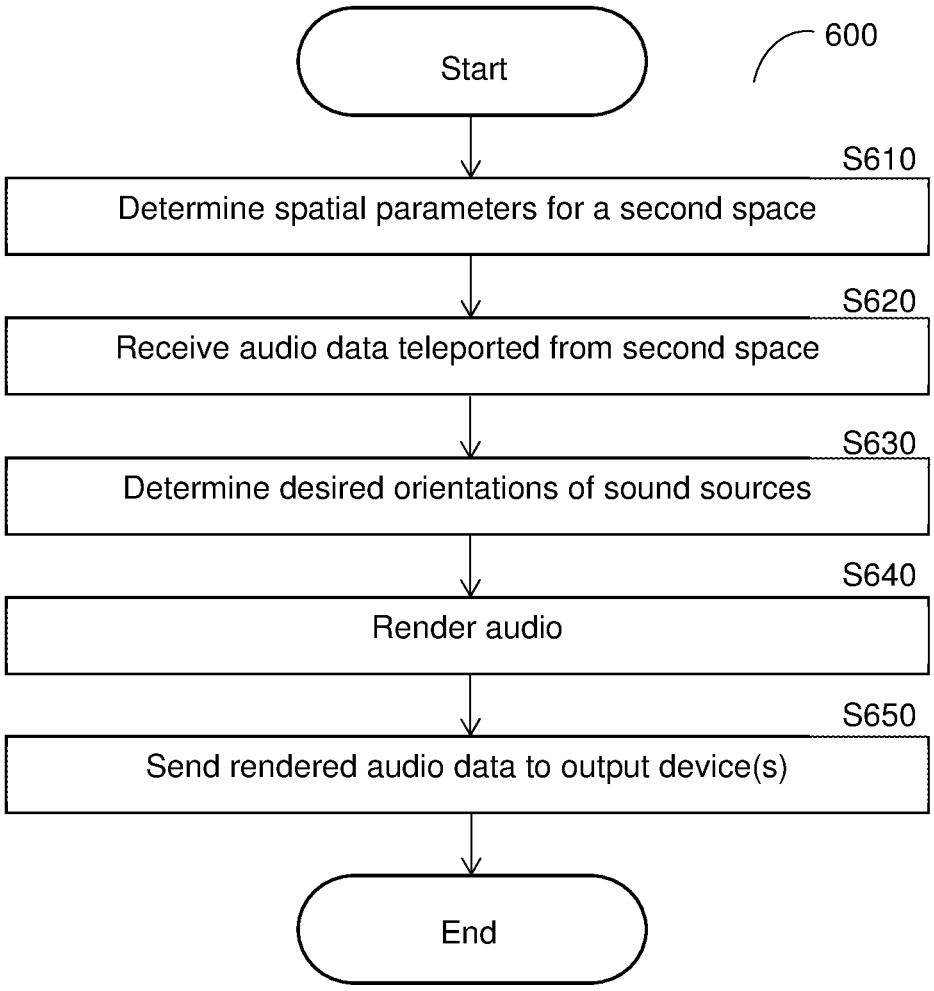
FIG. 6 is a flowchart illustrating a method for vocal interaction preservation of spatial audio reception according to yet another embodiment.

FIG. 6 is an example flowchart 600 illustrating a method for vocal interaction preservation of spatial audio reception according to yet another embodiment. In an embodiment, the method is performed by a spatial audio preserver such as the spatial audio preserver 170, FIG. 2.

At S610, the spatial parameters of a second space (e.g., the second space 502, FIG. 5) are determined. The spatial parameters characterize the second space with respect to, for example, its inherent noise characteristics, acoustic characteristics, reverberation characteristics, or a combination thereof. This operation is performed using sound received by the microphone arrays without the presence of the sources to be teleported to the second space.

At S620, audio data teleported to the second space is received, for example, from the system deployed in a first space (e.g., the first space 501, FIG. 5). The audio data is captured by audio sources based on sound projected by sound sources in the first space and teleported to a system in the second space.

At S630, the desired orientations of the sound sources when teleported into the second space are determined or otherwise provided. In an embodiment, the desired orientation of a sound source may be different from the orientation of that sound source, but that the position and other characteristics of that sound source remain the same as they were of the first space. For example, if person A 110 and person B 120 in first space 501 were standing straight facing each other, then this will continue to be the orientation when put as an AR into second space 502.

At S640, audio is rendered based on the received sound and adjusted based on the spatial parameters of the second space as well as the desired orientations. In an embodiment, the received audio data is cleaned of noise and reverberation of the first space before rendering (e.g., as described above with respect to FIG. 3). Such cleaning may be performed as part of S640, or may be previously performed, for example, by another audio spatial preserver.

At S650, the adjusted audio data is sent to audio output device(s) (e.g., the headset 140, the speakers 150, or both, FIG. 1) for projection in the second space.

Figure 7:
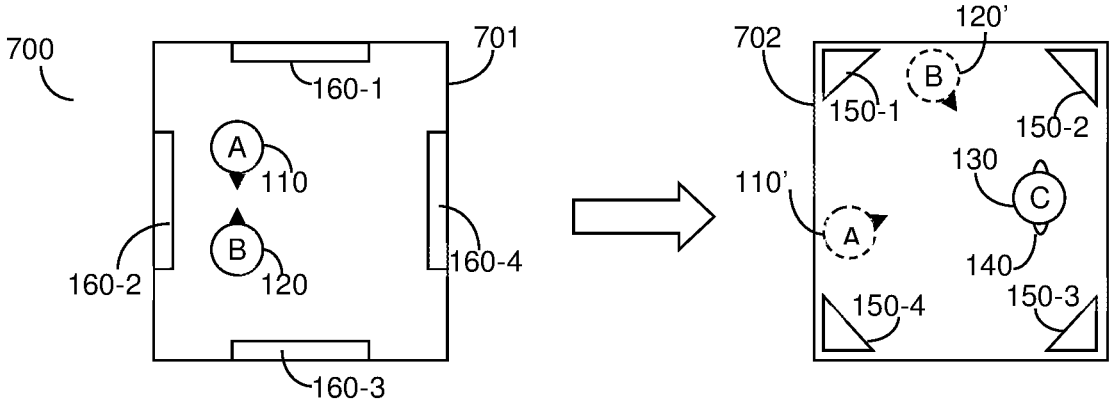
FIG. 7 is a flow diagram illustrating first and second spaces used for the purpose of vocal interaction preservation of spatial audio in altered realities with a reordered inertial orientation.

FIG. 7 is an example flow diagram 700 illustrating first and second spaces used for the purpose of vocal interaction preservation of spatial audio in altered realities with a reordered inertial orientation.

The initial setup in the first space 701 is the same as seen in FIG. 1 for the first space 101. In the example flow diagram 700, the first space 701 reflects the actual environment in which the audio is captured, including the relative positions and orientations of the persons A 110 and B 120 with respect to each other and to the audio sources (i.e., the microphone arrays 160).

In the AR setup visually represented by the second space 702, the avatar of person A 110' and the avatar of person B 120' are placed and oriented differently than the person A 110 and the person B 120 in the space 701. As a result, the avatar of person A 110' is oriented to the middle between the avatar of person B 120' and person C 130. In the second space 702, an avatar of person B 120' is positioned at a farther distance from person A 110 in comparison to the setup in the first space 701 and with an orientation facing toward the speaker 150-3.

In a further example (not visually depicted in FIG. 7), the avatar of person B 120' may be further oriented differently as compared to the person B 120, for example as sitting on a chair rather than standing. Therefore, in order to reproduce a realistic AR experience, it is necessary to manipulate the received audio which was captured and transmitted, for example, as described in FIG. 3.

In an embodiment, manipulating the received audio includes 1) determining the desired locations for each sound source within the second space; 2) determining the orientations of the sound sources with respect to each other (in this case person A 110 and person B 120) as well as with respect of the listener (in this case person C 130); and 3) rendering the sound according to the captured audio, the determined orientations, and the spatial parameters of the second space.

Figure 8:
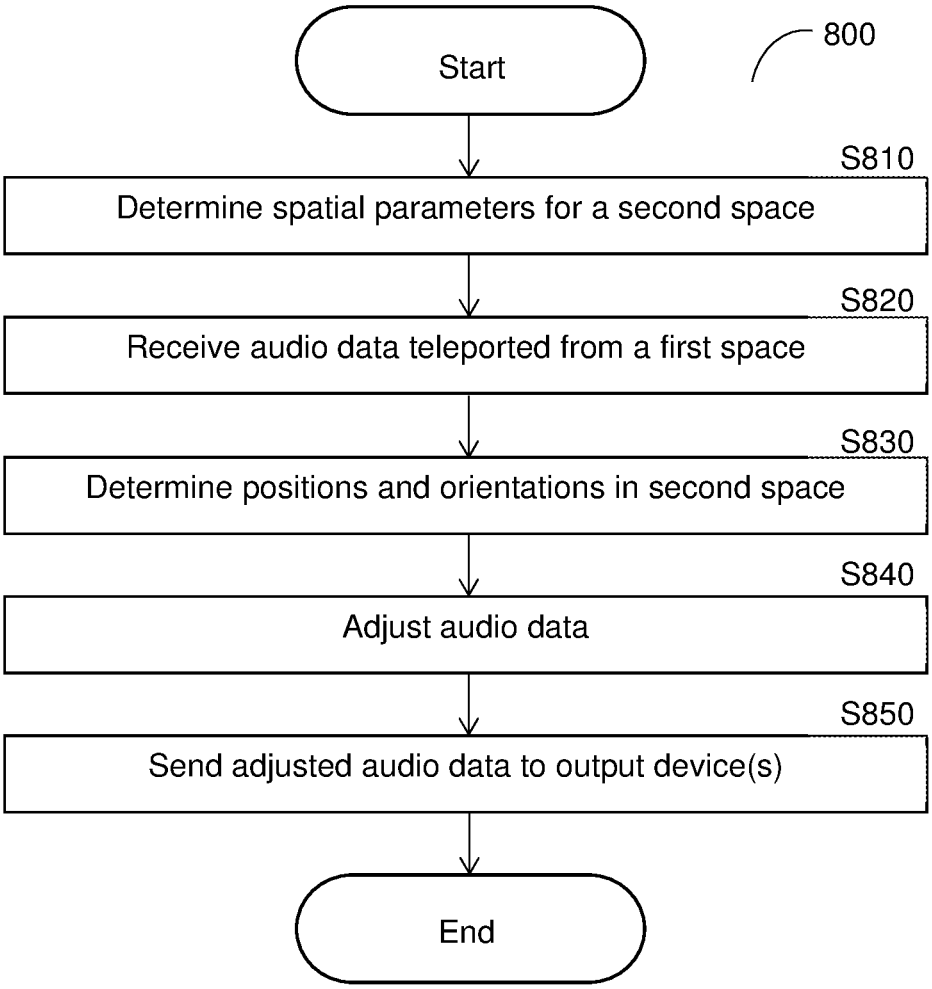
FIG. 8 is a flowchart illustrating a method for vocal interaction preservation of spatial audio reception according to yet another embodiment.

FIG. 8 is a flowchart 800 illustrating a method for vocal interaction preservation of spatial audio reception according to yet another embodiment. In an embodiment, the method is performed by a spatial audio preserver such as the spatial audio preserver 170, FIG. 2.

At S810, the spatial parameters of a second space (e.g., the second space 702, FIG. 7) are determined. The spatial parameters characterize the second space with respect to, for example, its inherent noise characteristics, acoustic characteristics, reverberation characteristics, or a combination thereof. This operation is performed using sound received by the microphone arrays without the presence of the sources to be teleported to the second space.

At S820, audio data destined for teleporting in the second space is received, for example, from a system deployed in a first space (e.g., the first space 701, FIG. 7).

At S830, the desired positions and orientations of the sound sources (e.g., the person A 110 and the person B 120)

are determined. This can be provided manually by a user of the system or automatically by the system itself. However, it should be understood that in this case the position and orientation of the sound sources is different from that which characterized the position and orientation of the received sound sources. One of ordinary skill in the art would readily appreciate that this position and orientation may change over time. For example, it may be desirable to orient person B 120 towards person A 110 when addressing that person according to the audio data received (which can be determined, for example, by determining the directionality of the audio energy) and thereafter oriented towards person C 130 when addressing that person.

At S840, sound is rendered based on the received audio data and adjusted according to the spatial parameters of the second space as well as the desired positions and orientations of the sound sources in the second space.

At S850, the adjusted audio data is provided to audio output device(s) (e.g., the headset 140, the speakers 150, or both, FIG. 1).

It should be noted that the various visual representations disclosed herein depict specific numbers of audio sources, sound sources, people, and the like, merely for illustrative purposes. Other numbers of audio sources, sound sources, people, and the like, may be present in spaces without departing from the scope of the disclosure.

Additionally, various visual illustrations depict two spaces merely for example purposes, and that the disclosed embodiments may be utilized to provide audio from more than two spaces. Likewise, various visual representations of spaces depicted herein illustrate one space including audio input devices (e.g., microphone arrays) and another space including audio output devices (e.g., speakers). However, the disclosed embodiments may be equally applicable to other setups. In particular, all spaces may include both audio input devices and audio output devices in accordance with the disclosed embodiments to allow for bidirectional teleportation with audio modified according to the disclosed embodiments.

The various embodiments disclosed herein can be implemented as hardware, firmware, software, or any combination thereof. Moreover, the software is preferably implemented as an application program tangibly embodied on a program storage unit or computer readable medium consisting of parts, or of certain devices and/or a combination of devices. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such a computer or processor is explicitly shown. In addition, various other peripheral units may be connected to the computer platform such as an additional data storage unit and a printing unit. Furthermore, a non-transitory computer readable medium is any computer readable medium except for a transitory propagating signal.

All examples and conditional language recited herein are intended for pedagogical purposes to aid the reader in understanding the principles of the disclosed embodiment and the concepts contributed by the inventor to furthering the art, and are to be construed as being without limitation to such specifically recited examples and conditions. Moreover, all statements herein reciting principles, aspects, and embodiments of the disclosed embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It should be understood that any reference to an element herein using a designation such as "first," "second," and so forth does not generally limit the quantity or order of those elements. Rather, these designations are generally used herein as a convenient method of distinguishing between two or more elements or instances of an element. Thus, a reference to first and second elements does not mean that only two elements may be employed there or that the first element must precede the second element in some manner. Also, unless stated otherwise, a set of elements comprises one or more elements.

As used herein, the phrase "at least one of" followed by a listing of items means that any of the listed items can be utilized individually, or any combination of two or more of the listed items can be utilized. For example, if a system is described as including "at least one of A, B, and C," the system can include A alone; B alone; C alone; 2A; 2B; 2C; 3A; A and B in combination; B and C in combination; A and C in combination; A, B, and C in combination; 2A and C in combination; A, 3B, and 2C in combination; and the like.

What is claimed is:

1. A method for vocal interaction preservation for teleported audio, comprising:

determining spatial parameters of a first space, the first space including at least one sound source and at least one audio source, wherein the at least one sound source emits sound within the first space, wherein the at least one audio source captures audio data based on sounds emitted within the first space, at least some of the sounds emitted within the first space to be teleported, wherein the spatial parameters of the first space characterize the first space with respect to sound characteristics of sounds emitted within the first space when there is no emittance in the first space of any sound to be teleported;

determining vocal spatial parameters of each of the at least one sound source, wherein the vocal spatial parameters of each sound source define characteristics of the sound source which affect sound waves emitted by the sound source; and generating, for each of the at least one sound source, a respective clean version of the audio data based on the spatial parameters of the first space and the vocal spatial parameters of the sound source.

2. The method of claim 1, further comprising:

determining spatial parameters of a second space, wherein the spatial parameters of the second space characterize the second space with respect to sound characteristics of sounds emitted within the second space; and generating, for each of the at least one sound source, an adjusted version of the audio data based on the respective clean version of the audio data and the spatial parameters of the second space.

3. The method of claim 2, further comprising:

causing projection of each adjusted version of the audio data in the second space.

4. The method of claim 1, wherein the at least one audio source is at least one microphone array.

5. The method of claim 1, wherein the spatial parameters include at least one of noise, acoustics, and reverberation parameters.

6. The method of claim 1, wherein the vocal spatial parameters of each sound source include directionality of facing of a sound emitting point of at least one of the at least one sound source.

7. A non-transitory computer readable medium having stored thereon instructions for causing a processing circuitry to execute a process, the process comprising:

determining spatial parameters of a first space, the first space including at least one sound source and at least one audio source, wherein the at least one sound source emits sound within the first space, wherein the at least one audio source captures audio data based on sounds emitted within the first space, at least some of the sounds emitted within the first space to be teleported, wherein the spatial parameters of the first space characterize the first space with respect to sound characteristics of sounds emitted within the first space when there is no emittance in the first space of any sound to be teleported;

determining vocal spatial parameters of each of the at least one sound source, wherein the vocal spatial parameters of each sound source define characteristics of the sound source which affect sound waves emitted by the sound source; and generating, for each of the at least one sound source, a respective clean version of the audio data based on the spatial parameters of the first space and the vocal spatial parameters of the sound source.

8. A system for vocal interaction preservation for teleported audio, comprising:

a processing circuitry; and a memory, the memory containing instructions that, when executed by the processing circuitry, configure the system to:

determine spatial parameters of a first space, the first space including at least one sound source and at least one audio source, wherein the at least one sound source emits sound within the first space, wherein the at least one audio source captures audio data based on sounds emitted within the first space, at least some of the sounds emitted within the first space to be teleported, wherein the spatial parameters of the first space characterize the first space with respect to sound characteristics of sounds emitted within the first space when there is no emittance in the first space of any sound to be teleported;

determine vocal spatial parameters of each of the at least one sound source, wherein the vocal spatial parameters of each sound source define characteristics of the sound source which affect sound waves emitted by the sound source; and generate, for each of the at least one sound source, a respective clean version of the audio data based on the spatial parameters of the first space and the vocal spatial parameters of the sound source.

9. The system of claim 8, wherein the system is further configured to:

determine spatial parameters of a second space, wherein the spatial parameters of the second space characterize the second space with respect to sound characteristics of sounds emitted within the second space; and generate, for each of the at least one sound source, an adjusted version of the audio data based on the respective clean version of the audio data and the spatial parameters of the second space.

10. The system of claim 9, wherein the system is further configured to:

cause projection of each adjusted version of the audio data in the second space.

11. The system of claim 8, wherein the at least one audio source is at least one microphone array.

12. The system of claim 8, wherein the spatial parameters include at least one of noise, acoustics, and reverberation parameters.

13. The system of claim 8, wherein the vocal spatial parameters of each sound source include directionality of facing of a sound emitting point of at least one of the at least one sound source.

14. A method for vocal interaction preservation for teleported audio, comprising:

determining spatial parameters of a second space, wherein the spatial parameters of the second space characterize the second space with respect to sound characteristics of sounds emitted within a first space when there is no emittance in the second space of any teleported sound; and generating, for each of at least one sound source in a first space, an adjusted version of audio data based on audio data captured in the first space and the spatial parameters of the second space, wherein the audio data is captured based on sound emitted by the at least one sound source in the first space.

15. The method of claim 14, wherein the adjusted version of the audio data for each of the at least one sound source is determined based further on a desired orientation of the sound source with respect to the second space.

16. The method of claim 15, wherein the desired orientation of each sound source with respect to the second space is different from an actual orientation of the sound source in the first space.

17. The method of claim 15, wherein the desired orientation of each sound source with respect to the second space is an orientation of an avatar of the sound source in an altered reality environment, wherein at least a portion of the altered reality environment is virtual.

18. The method of claim 15, wherein the adjusted version of the audio data for each of the at least one sound source is determined based further on a desired position of the sound source with respect to the second space.

19. The method of claim 14, further comprising:

projecting each adjusted version of the audio data via at least one audio output device deployed in the second space.

20. The method of claim 19, wherein the at least one audio output device includes at least one of: at least one loudspeaker, and binaural headphones.

21. A non-transitory computer readable medium having stored thereon instructions for causing a processing circuitry to execute a process, the process comprising:

determining spatial parameters of a second space, wherein the spatial parameters of the second space characterize the second space with respect to sound characteristics of sounds emitted within a first space when there is no emittance in the second space of any teleported sound; and generating, for each of at least one sound source in a first space, an adjusted version of audio data based on audio data captured in the first space and the spatial parameters of the second space, wherein the audio data is captured based on sound emitted by the at least one sound source in the first space.

22. A system for vocal interaction preservation for teleported audio, comprising:

a processing circuitry; and a memory, the memory containing instructions that, when executed by the processing circuitry, configure the system to:

determine spatial parameters of a second space, wherein the spatial parameters of the second space characterize the second space with respect to sound characteristics of sounds emitted within a first space when there is no emittance in the second space of any teleported sound; and generate, for each of at least one sound source in a first space, an adjusted version of audio data based on audio data captured in the first space and the spatial parameters of the second space, wherein the audio data is captured based on sound emitted by the at least one sound source in the first space.

* * * * *